United States Patent [19]

Rice

[11] 4,050,194

[45] Sept. 27, 1977

[54] MULTI-ANGLE SANDER

[76] Inventor: Jessie A. Rice, 8427 Jamestown Drive, Austin, Tex. 78758

[21] Appl. No.: 646,590

[22] Filed: Jan. 5, 1976

[51] Int. Cl.[2] ..... B24B 7/16

[52] U.S. Cl. ..... 51/128; 51/273; 83/581; 144/253 G

[58] Field of Search ..... 51/102, 128, 209 R, 51/273, 125, 125.5, 98, 95.5, 358, 135 R; 144/253 R, 253 G, 253 E; 83/581, 471.3, 477.2

[56] References Cited

U.S. PATENT DOCUMENTS

| | | | |
|---|---|---|---|
| 926,101 | 6/1909 | Connet | 51/128 |
| 1,193,525 | 8/1916 | Dosch | 51/128 |
| 1,751,137 | 3/1930 | Ehrlinger | 51/98 R X |
| 2,052,837 | 9/1936 | Makaroff | 51/102 |
| 2,416,493 | 2/1947 | Newton | 51/102 X |
| 2,680,458 | 6/1954 | Grammer | 144/253 R X |
| 2,728,364 | 12/1955 | Muehling | 51/128 X |
| 3,270,467 | 9/1966 | Block | 51/358 |
| 3,454,055 | 7/1969 | Schnettler | 83/471.3 |

*Primary Examiner*—Al Lawrence Smith
*Assistant Examiner*—Nicholas P. Godici
*Attorney, Agent, or Firm*—Clarence A. O'Brien; Harvey B. Jacobson

[57] ABSTRACT

A multi-angle sander for accurately sanding the corners of picture frame moldings and the like having a stand structure supporting a rotatable multi-element sanding disk with adjustable guide brackets on said table for the purpose of guiding the material being sanded at the correct angle to the rotating sanding disk. Motor means mounted within the stand drive the rotatable disk and suction means also provided within the stand remove sawdust particles as rapidly as they are produced.

5 Claims, 7 Drawing Figures

MULTI-ANGLE SANDER

BACKGROUND OF THE INVENTION

1. Field of the Invention

This invention relates generally to sanders and in particular to sanders which have adjustable guide structure for accurately holding pieces to be sanded so that the proper angle will be formed at the ends thereof.

2. Description of the Prior Art

Generally in the making and construction of four-corner structures such as picture frames, table moldings, etc., a common known problem is in accurately forming the mating corners of the pieces. Oftentimes inexperienced, and even sometimes fairly experienced craftsmen, will form their corner joints and assemble the frames only to find that the last corner fails to properly mate.

Known prior art miter boxes and the like do tend to solve this problem in part, but are not completely satisfactory.

SUMMARY OF THE INVENTION

An object of the present invention is to provide a sander device having adjustable guide structure so that multi-angle ends may be sanded on workpieces.

Another object of the present invention is to provide a multi-angle sander having a support stand with an exhaust system contained therein to eliminate the problem of sawdust accumulation.

A further object of the present invention is to provide a multi-angle sander having a large range of adjustments of angles which may be properly sanded.

A still further object of the present invention is to provide a sander device having a removable top structure for easy access to the interior of the support stand and for easy maintenance of the over-all device.

Another further object of the present invention is to provide a multilayer sanding disk having outer sanding elements supported on a Masonite internal member for the purpose of achieving a cooler running operating condition.

Another still further object of this invention is to provide a sawdust removing exhaust system which may utilize a conventional vacuum system such as the home vacuum cleaner. The purpose being to reduce the over-all cost of the device.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
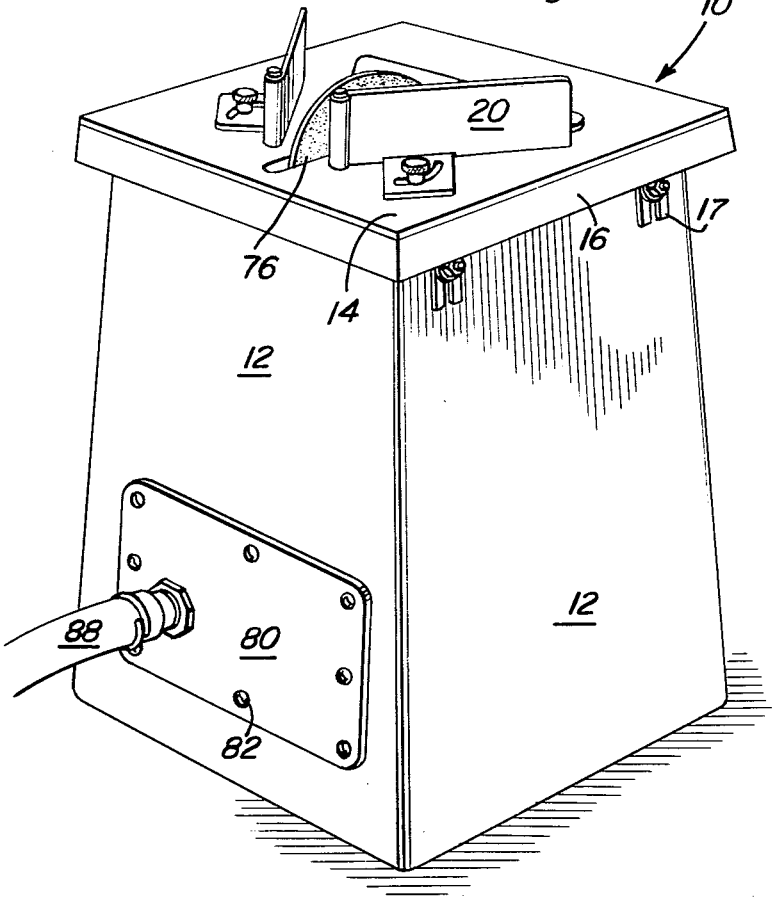
FIG. 1 is a perspective view of the multi-angle sander of this invention.
Figure 6:
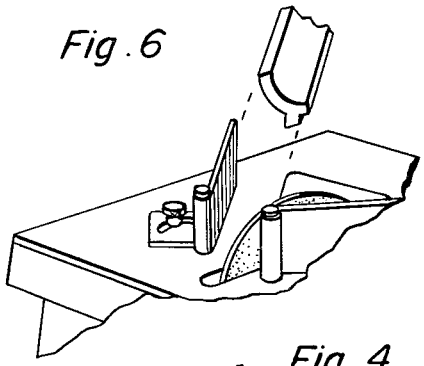
FIG. 6 is a perspective view, in part, showing a piece of picture molding ready to be sanded by the device.
Figure 3:
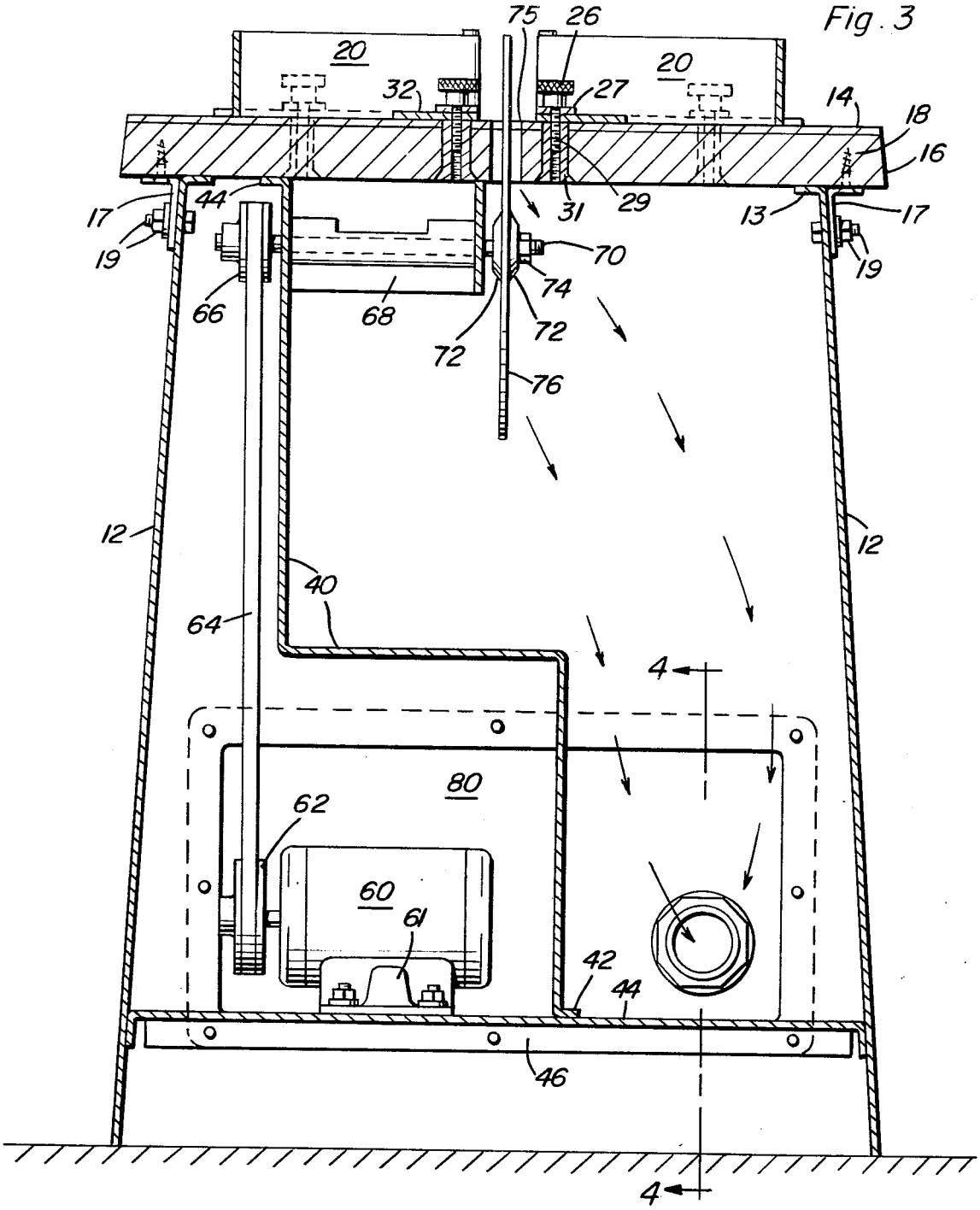
FIG. 3 is a front cross-sectional view taken generally along line 3—3 of FIG. 2.
Figure 5:
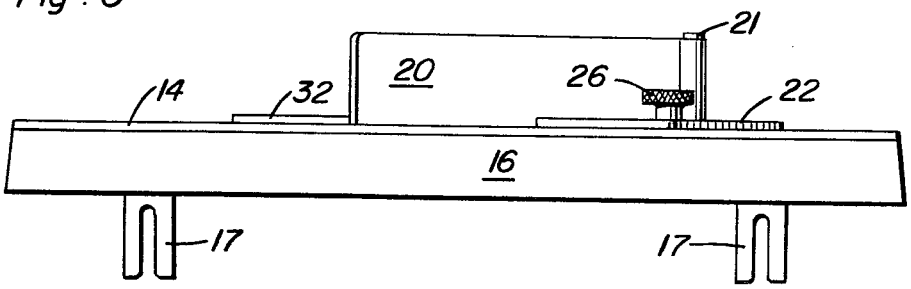
FIG. 5 is a side elevational view of the top mounting structure as viewed from the right of FIG. 2.

Referring now more particularly to the drawing, reference numeral 10 in FIG. 1 indicates the over-all multi-angle sander of this invention. This device includes a supporting stand having rectangular tapered sides 12 forming a support approximately waist high and of firm rigid construction for providing a good work surface for the sander tabletop. The base structure may be made of metal, plastic, or other suitable semi-rigid and strong material. Mounted on top of the support stand is the primary support table for the sander unit and guiding structure therefor which includes a table surface 14 of Formica, Masonite, or other durable material supported by a wooden body portion 18 with side edges 16; edges 16 may be formed of the same material as the tabletop 14. This entire top is removably attached to the upper portion of the support frame by means of slotted brackets 17 which are appropriately fastened, as best seen in FIG. 3, by means of wood screws or the like to the under surface thereof. The slotted portions of the brackets 17 permit the top to be easily removed from the support stand but normally are fastened to the top of the support stand by means of nuts and bolts such as 19 shown in FIG. 3.

The guiding structure for the material to be sanded is mounted on the top surface of the tabletop and includes the following. Guide members 20 are pivotally mounted on pins 21 permanently secured in the tabletop and the guides 20 have perpendicular flanged portions 22 integral with the lower edge thereof with the flanged portions having arcuate slots 24 therein for guiding and locking by means of enlarged head locking screws 26. These screws may best be seen in FIG. 3 wherein the enlarged head 26 is preferably knurled to provide a fingergripping surface thereon, a washer 27 freely rotatable thereabout, and a screw-threaded portion 29 which screws into the hollow threaded inserts 31 mounted in appropriate holes within the table member 18 in a permanent manner. The guide plates 32 consist of triangular shaped flat members also provided with adjustment slots 34 and are likewise mounted on the table by means of locking screws 26. It can be readily visualized that by slightly loosening one or more of the locking screws 26, the respective angle guides 20 and 32 may be positioned and angled as desired to form a guiding structure to sand the correct or desired angle on a piece of picture molding and the like. Obviously once properly adjusted the locking screws 26 will be tightly secured in order to maintain the desired adjustment and angle.

Mounted within the supporting structure is a step-like baffle 40 having flanged edges 42 and 44 for appropriate engagement with the bottom panel 44 and the tabletop body member 18. The bottom panel 44 has depending flange edges 46 with said flanges 46 being appropriately bolted or riveted to the bottom sides of the main support element 12. This panel member 44 increases the strength and rigidity of the over-all support structure greatly. A supporting structure 68 having aligned sleeve or roller bearings therein is appropriately mounted at the upper portion of the support stand (by means not shown) in FIG. 3 for rotatably supporting the sander disk arbor 70. The drawings show the sander disk 76 being mounted by appropriate disk washers 72 on the arbor shaft 70 by means of a locking nut 74. An aperture 75 is appropriately provided in the tabletop of adequate length and width to permit the entire diameter of the maximum usable size sanding disk to pass therethrough. On the opposite side of the support bearing 68 from the sanding disk a driven pulley 66 is provided by conventional locking means to the end of shaft 70. A drive belt 64 is driven by pully 62 mounted on the drive motor 60 which is appropriately supported by means 61 on the panel member 44.

Another new and unique feature of this invention is in the sawdust removing structure, which makes up the other side of the structure from the motor and belt side, as best seen in FIG. 3. A removable panel 80 appropriately fastened to the rear wall of the main supporting structure by screws 82, and the like, covers an enlarged rectangular opening 81 in said rear wall. This removable cover plate is provided in order to permit ready access to the lower inside of the support structure for the purpose of removing any accumulated sawdust from the one compartment and/or removing, replacing or adjusting the motor 60 and associated support structure in the other compartment.

Figure 4:
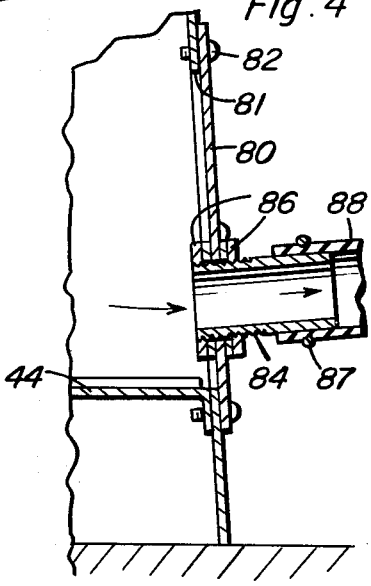
FIG. 4 is a cross-sectional view, in part, of the exhaust system external connection looking from the left of FIG. 1 toward the right thereof.

Looking at FIG. 4, the exhaust connection to the removable plate 80 may be seen. The connector consists of a member 84 being appropriately threaded at one end thereof for receiving locking washers and nuts 86 in order to positively fasten said tubular member to an appropriate aperture in the panel 80. The other end of member 84 has a smooth outer surface for reception of a conventional vacuum cleaner hose 88 with retaining spring 87 thereon. Obviously other type tubular connectors may be used in place of this one with the primary object being to have a fitting which will take the end of a conventional vacuum cleaner hose quickly and easily. When the sander is being used appropriate vacuum will be applied at this fitting by means of the vacuum system from the other end of hose 88 which will continually draw sawdust from the inside of the structure, as best depicted in FIG. 3 by the arrows, to quickly and completely remove any sawdust as a result of the sanding operation. Normally sawdust accumulation in such operations is a common occurrence and a very annoying one. An accumulation of sawdust would interfere with the operator's clear viewing of the sanding operation and would obviously interfere with the proper sanding operation.

Figure 7:
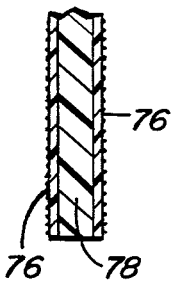
FIG. 7 is a cross-sectional view, in part, of a portion of the multi-element sanding disk as used with this invention.
Figure 2:
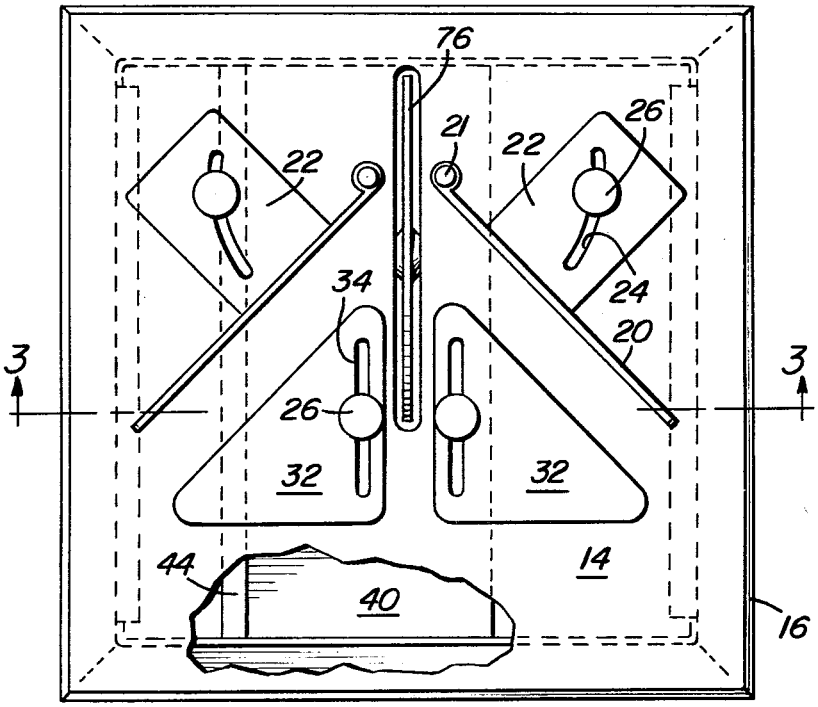
FIG. 2 is a top plan view of the device as shown in FIG. 1.

Another important feature of this invention is in the sanding disk itself. It has been discovered that a disk employing Masonite as the primary support member for the sanding portions runs cooler and is much more effective than disks made of metal. FIG. 7 shows the disk edge approximately actual size. A Masonite disk of approximately one-fourth inch thickness has been found to be quite satisfactory and such a disk is appropriately coated with sanding material or sanding paper disks 76 on both sides thereof. This combination disk has been found in use to run very cool and can be used for long periods of time without any problems.

From the drawings and above description it can be seen that a strong rigid support structure is provided having a separate motor and drive component compartment from a sawdust transfer and exhaust compartment, and a rigid, strong over-all structure with a removable tabletop portion to permit quick and easy access to the top interior portion of the device and also to simplify quick and easy replacement of the sander disk itself on the drive arbor. The adjustable guide plates and members also are quite effective. The adjusting guides may be quickly adjusted and set to any multi-angle desired for proper guiding of the workpiece and yet positively locked in said desired position by means of the locking screws 26.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A multi-angle sander device comprising; a support structure, a removable top member on said support structure having a longitudinal aperture therein, a rotatably drive mounted within said support structure, sander means mounted on said rotatable drive and passing through said aperture for sanding angles on workpieces and running cool and not burning, and adjustable guide means mounted on the top member for guiding workpieces being sanded at the proper angle to the sanding means, the adjustable guide means includes at least one rectangular guide plate member pivotally mounted perpendicular to the surface of the top member and having a slotted adjusting flange integral therewith, and the adjustable guide means includes two of the pivotally mounted rectangular guide plate members and further includes an enlarged head locking screw guidingly mounted in the slot of the flanged member of each of the rectangular guide plate members and engaging with a screw-threaded member fastened in the removable top member for the purpose of positively locking the rectangular guide plate members once they are adjusted, and additional flat triangular shaped guide plates which complement the pivotally mounted rectangular guide plate members, said flat triangular shaped guide plates having adjusting apertures therein and being adjustably locked to the top member by enlarged head locking screws.

2. The structure set forth in claim 1, wherein the sanding means includes a Masonite disk mounted on the rotatable drive, said Masonite disk having a sandpaper surface on at least one side thereof.

3. The structure as set forth in claim 2, together with an exhaust compartment within the support structure connectable to a vacuum source for exhausting sawdust from the device.

4. A sander device for sanding multi-angle ends on workpieces comprising; a substantially cubical support structure having a removable top member, a longitudinal aperture in said top member, a drive motor mounted within said support structure, a pulley on said drive motor, a bearing arbor supported within said support structure and connected to the pulley on the drive motor by a drive belt and pulley on said arbor, a sanding disk means mounted on the other end of said arbor and passing through the aperture in the removable top member, adjustable guide means mounted on the top surface of the removable for maintaining a desired angle of sanding, at least four slotted brackets attached to the underside of the removable top member and held by nuts and bolts to the substantially cubical support structure, and sawdust removing means associated with the substantially cubical support structure which is adapted to utilize the conventional home vacuum cleaner, the sanding disk means for cool sanding of workpieces including a Masonite disk of approximately one-fourth inch in thickness suitably coated with sanding material on at least one surface thereof, the adjustable guide means mounted on the removable top including two pivotally mounted rectangular guide members having adjusting flanges perpendicular to the guide members integral therewith an arcuate slots in said adjusting flanges, said adjusting flanges slidable along the top surface of the top and adjustably retained in position thereon by locking screws, and additional guide means which includes two flat triangular shaped guide members having arcuate corners and each said plate being provided with a longitudinal slot for permitting the guide plates to be slid and rotated on the top surface of the removable top and positively retained in adjusted position by means of large head locking screws.

5. The structure as set forth in claim 4, wherein the sawdust removing means which is adapted to utilize a conventional home vacuum cleaner includes a removable panel on one side of the substantially cubical support structure, and an exhaust connection is mounted on said removable panel which is adapted to connect to a conventional vacuum cleaner connector.

* * * * *